United States Patent [19]

Schleicher

[11] 3,968,915

[45] July 13, 1976

[54] TAPE DISPENSER

[76] Inventor: Ernst E. Schleicher, 7954-56 MacArthur Blvd., Oakland, Calif. 94605

[22] Filed: Apr. 28, 1975

[21] Appl. No.: 572,345

Related U.S. Application Data

[63] Continuation-in-part of Ser. No. 490,900, July 22, 1974, abandoned.

[52] U.S. Cl. ..... 225/65

[51] Int. Cl.[2] ..... B65H 35/06

[58] Field of Search ..... 225/58, 65, 66, 56, 225/61, 54–57, 67–74, 59, 60; 221/70

[56] References Cited

UNITED STATES PATENTS

| | | | |
|---|---|---|---|
| 3,134,526 | 5/1964 | Schleicher | 225/56 |
| 3,484,030 | 12/1969 | Mattheis | 225/66 X |

FOREIGN PATENTS OR APPLICATIONS

| | | | |
|---|---|---|---|
| 886,747 | 1/1962 | United Kingdom | 225/66 |

*Primary Examiner*—Stanley H. Tollberg
*Attorney, Agent, or Firm*—Theodore J. Bielen, Jr.; Richard Esty Peterson

[57] ABSTRACT

A tape dispenser for use with a conventional tape roll, the tape dispenser has a finger grip piece insertable within the core of tape roll and a cover piece pivotally engageable with the holding piece for adjustably encompassing part of the periphery of the tape roll, the cover piece is contoured to be gripped with the holding piece to position the cover piece against the periphery of the tape roll for dispensing tape pulled from the roll at a controlled tension, and, the cover piece includes a projecting dispensing end with a tape guide and cutting edge for guiding and severing tape pulled from the tape roll.

11 Claims, 15 Drawing Figures

FIG. 1
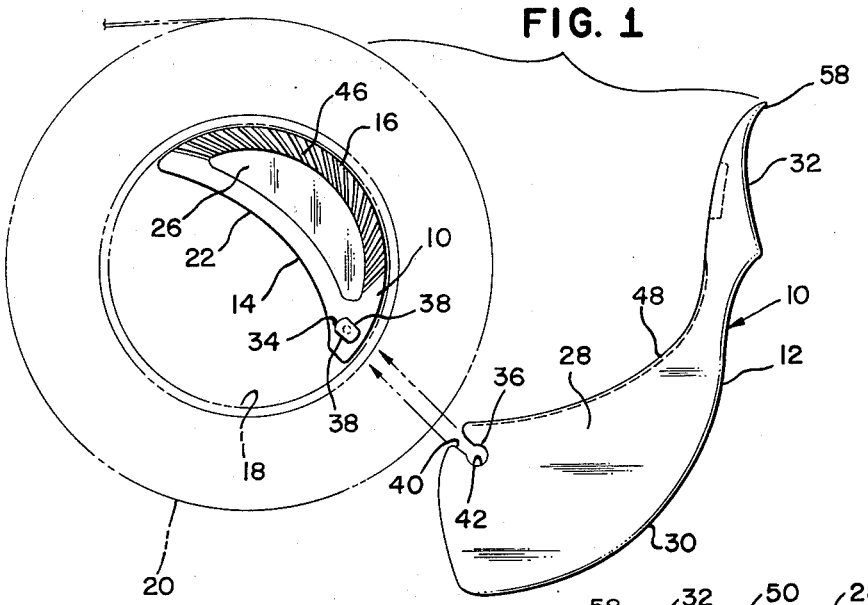
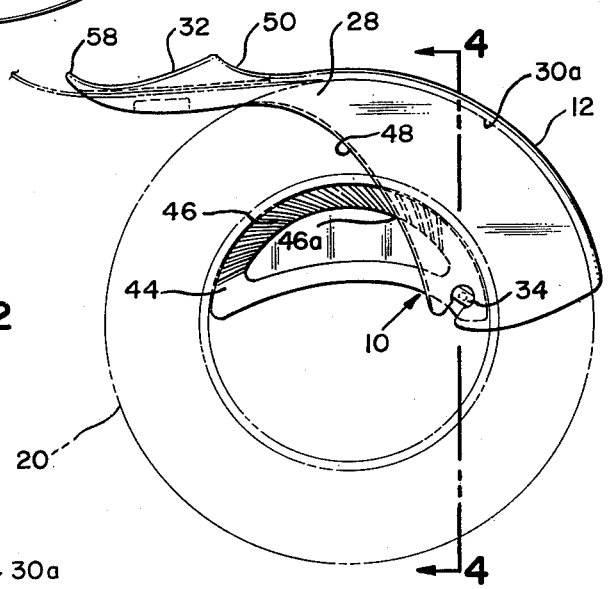
FIG. 2
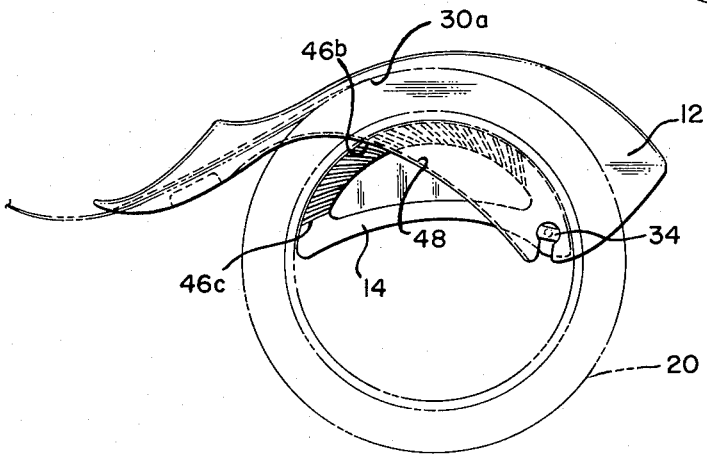
FIG. 3

TAPE DISPENSER

CROSS-REFERENCES TO RELATED APPLICATIONS

This application is a continuation-in-part of my application entitled, *TAPE DISPENSER*, Ser. No. 490,900, filed July 22, 1974 now abandoned.

BACKGROUND OF THE INVENTION

This invention relates to a tape dispenser or tape holder, particularly of the kind which may be held for manually stripping and severing a length of tape from a conventional tape roll. The tape dispenser of this invention is of the same general type as that described in my U.S. Pat., No. 3,134,526, issued May 26, 1964, entitled *TAPE HOLDER*.

The tape dispenser of the present invention provides a convenient dispenser for storing and dispensing tape stored on conventional tape rolls of the type having a hollow core around the periphery of which is wrapped a quantity of tape. The dispenser is designed for coupling to a tape roll to provide a dispenser as portable as the roll alone, but adding a device for gripping, dispensing, and severing tape from the roll. The tape dispenser is particularly useful for dispensing and cutting packaging tape of the type having fibers in a tape lamina, which usually must be cut with the aid of a knife or other sharp cutting edge. The dispenser is simple and comfortable to operate, adjusting automatically to accommodate a gradually depleting tape roll.

SUMMARY OF THE INVENTION

The tape dispenser of this invention is operable with a conventional tape roll of the type having a hollow central core. The dispenser has a finger grip piece insertable within the core of the tape roll. Engageable with the finger grip piece is a cover piece which is arranged over a portion of the periphery of a tape roll and pivotally connected to the finger grip on an axis generally parallel to the central axis of the cylindrical tape roll.

The cover piece is fabricated with two contoured side sections which straddle the side of the tape roll. The side sections include a connecting means for pivotally connecting the cover piece to the finger grip piece located within the core of the tape roll. A top section connects the two side sections over the outside of the tape roll and is contoured in part to the circular peripheral surface of the tape roll. The cover piece has an extension formed by a projection of the top section and the two tapering side sections. At the end of the extension is a tape guide and a cutting edge for respectively guiding the tape along the underside of the extension and severing a drawn segment of tape from the roll. The cutting edge has a serrated edge integral with the extension and further has means for inserting a reversible, two edge metal blade where the serrated edge is inadequate for cutting certain types of tape, such as the fiber laminated packaging types.

These features of the tape dispenser create a device that is versatile as well as simple and convenient to operate.

BRIEF DESCRIPTION OF THE DRAWINGS

FIG. 1 is a side elevational view of the tape dispenser with separated constituent parts and a full tape roll.

FIG. 2 is a side elevational view of the tape dispenser of FIG. 1 with engaged constituent parts and a full tape roll.

FIG. 3 is a side elevational view of the tape dispenser of FIG. 2 and a partially exhausted tape roll.

DETAILED DESCRIPTION OF THE PREFERRED EMBODIMENT

Figure 5:
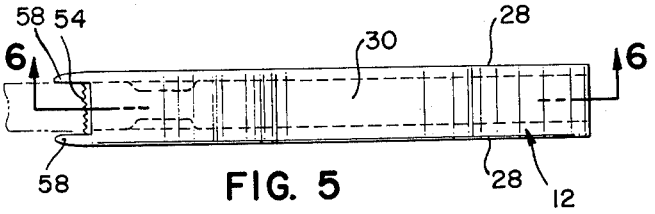
FIG. 5 is a top view of the cover part of the tape dispenser of FIG. 1.

Referring to FIG. 1, the preferred embodiment of the tape dispenser designated generally by the reference numeral 10 is shown. The tape dispenser comprises principally two separable parts, a cover piece 12 and a core or finger grip piece 14. The finger grip piece 14 is cresent-shaped having a partially circular peripheral section 16 contoured to fit snugly within an annular core 18 of a tape roll 20, shown in phantom in the figures. The core 18 of the tape roll 20 is customarily fabricated from cardboard and is generally of a standard size, such as 3 inches in diameter. Opposite the circular section 16 on the finger grip piece is a peripheral concave section 22 against which the fingers of a user of the dispenser are placed during operation. The center of the finger grip piece 14 may be hollowed or, as shown, may include a web 26 for strength.

The cover piece is contoured with two side sections 28 (one shown in FIG. 1) and a connecting back or top section 30, shown with greater clarity in FIG. 5. The side sections 28 and top section 30 taper to an extension 32 from which tape is dispensed and severed, as described in greater detail hereafter.

Figure 8:
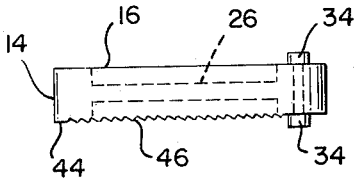
FIG. 8 is a top view of the core part of the tape dispenser of FIG. 1.
Figure 4:
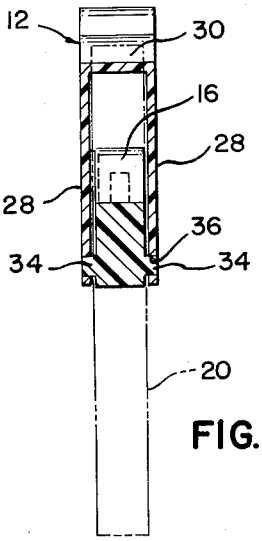
FIG. 4 is a cross-sectional view of the tape dispenser taken on the lines 4—4 in FIG. 2.

At one corner of the cresent-shaped grip piece 14 are oppositely disposed studs 34, as shown in FIGS. 1 and 8. The studs engage keyhole slots 36 on the two side sections 28 of the cover piece 12 to provide a pivotal hinge connecting the two pieces. To inhibit disengagement of the two pieces, the studs are generally cylindrical with two oppositely beveled sides 38. The beveled sides are arranged in alignment with a slot section 40 of the keyhole 36 to enable the studs to pass to a circular section 42 of the keyhole, as demonstrably illustrated by the pair of directional arrows in FIG. 1. Once the cover piece 12 is engaged and reoriented to the operable position shown in FIGS. 2 and 4, the two pieces are unable to disengage at the point of pivot.

Referring to FIGS. 2 and 8, the finger grip 14 includes along one side edge 44 of the peripheral section 16 a series of detents or notches 46 which engage a projecting lip 48 along the inside edge of one of the side sections 28 to the cover piece. This projecting lip 48 is shown in the underside view of the cover piece 12 in FIG. 7. With reference to FIGS. 2 and 3, the cover piece is installed over a portion of the tape roll 20 such that the underside 30*a* of the top section 30 rests against the periphery of the tape roll. In FIG. 2, when the roll is full, the lip 48 engages one of the notches 46a relatively close to the pivot studs 34. The cover piece 12 and grip piece 14 remain in this position during periods of non-use or when transported. This feature prevents inadvertent disengagement of the cover piece and retentively keeps the dispenser in ready operating position. As the tape roll depletes, for example, to the condition shown in FIG. 3, the cover piece 12, when gripped with the finger grip piece 14, gradually shifts to the position shown. The projecting lip consecutively engages the series of notches to the notch 46*b*, shown in FIG. 3. The pressure of the grip during expendature of tape disengages the lip from one notch by flexure of the side section 28 on which the lip 49 is located and shifts to the next adjacent notch. The gradual shift is limited by the contact of the underside 30*a* of the top section 30 against the periphery of the tape roll. As the tape roll depletes, the projecting lip 48 systematically moves to the last notch 46*c* on the finger grip piece shown in FIG. 3.

Figure 6:
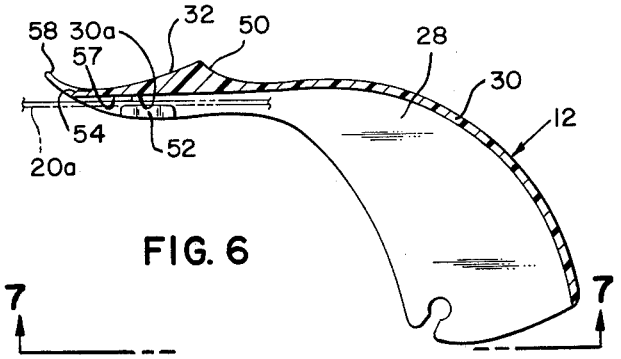
FIG. 6 is a cross-sectional elevational view of the cover part of the tape dispenser of FIG. 5

Referring to FIG. 2, the tape is drawn from the tape roll against the tapered extension 32. The extension 32 includes a contoured thumb seat 50 for the convenience and comfort of the operator when gripping the cover piece 12 and finger grip piece 14. Oppositely mounted on the inside of the side sections 28 of the extension 32 are two protruding tape guides 52, shown more clearly in the cross-sectional view and the underside view of the cover piece 12 in FIGS. 6 and 7, respectively. The tape guides 52 comprise oppositely facing protrusions on the side sections 28 of the extension, spaced from the underside 30 of the top section, to provide a channel through which tape is dispensed. The tape guides 52 are spaced sufficiently apart to permit a section of tape 20*a* (shown in phantom) to be pulled up against the underside 30*a* of the top section such that the edges of the tape pass by and then are retained by the two guides 52. This is accomplished by gripping the cover piece and finger grip piece at the end of the tape is pulled to generate a tension in the tape as it is dispensed. This manner of imparting a tension can be used for other applications in the controlled dispensing of tape.

To sever a section to tape 20*a* from the roll 20, the tape is lifted against an integral serrated adge 54, shown in FIG. 5. However, when the serrated edge is inadequate to sever certain kinds of tape, such as the fiber-laminated type, a reversible knife blade 56 can be inserted in two oppositely disposed grooves 57 (shown in dotted line in FIG. 7) at the end of the extension 32. The projecting first cutting edge 56*a* can be replaced with a second more pointed cutting edge 56*b* merely withdrawing the knife blade and reversing the edges before replacement.

Figure 7:
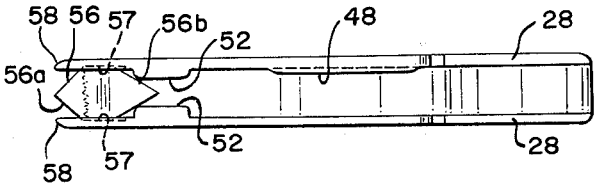
FIG. 7 is a bottom view of the cover part taken on the lines 7—7 in FIG. 6 showing an optional knife edge insert.

To reduce the chance of accidental injury from the knife blade 56, the side section 28 of the extension 32 tapers to a point 58 beyond the end of the projecting cutting edge, as shown in FIG. 7. In this manner, the cutting edge is blunted on accidental contact with a foreign surface.

Figure 9:
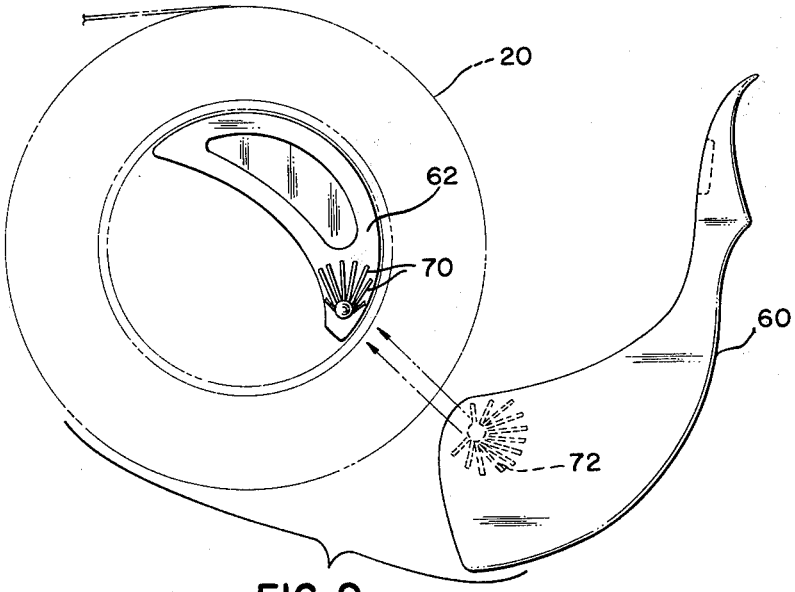
FIG. 9 is a side elevational view of a modified tape dispenser with separated constituent parts and a tape roll.
Figure 10:
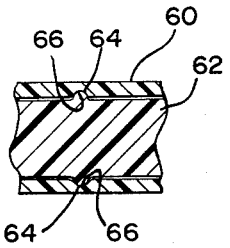
FIG. 10 is a cross-sectional view of a fragmentary portion of the modified tape dispenser showing the manner of engagement of the constituent parts.

While the above described embodiment is preferred, it should be understood that certain modifications can be made without departing from the scope and spirit of the invention. For example, referring to FIG. 9 and 10, a cover piece 60 similar to that shown in FIGS. 1 and 2 is connected to a finger piece 62 arranged in a tape roll 20 by oppositely projecting bosses 64 on the finger piece 62 which engage oppositely directed circular recesses 66 on the inside of two side sections 68 of the cover piece, as shown in FIG. 10. To control the pivotal position of the cover piece 60 with respect to the finger grip piece 62, a ridge and groove facing 70 on the finger grip piece 62 that radially projects from the boss 64 engages a concomitant ridge and groove facing 72 on the inside of the side sections 68 of the cover piece. As the cover piece adjusts to a diminishing tape roll, the ridge and groove facing 72 on the cover piece shifts incrementally on the ridge and groove facing 70 on the finger grip, thereby maintaining the relative position of the cover piece 60 with respect to the finger grip piece 62.

Figure 11:
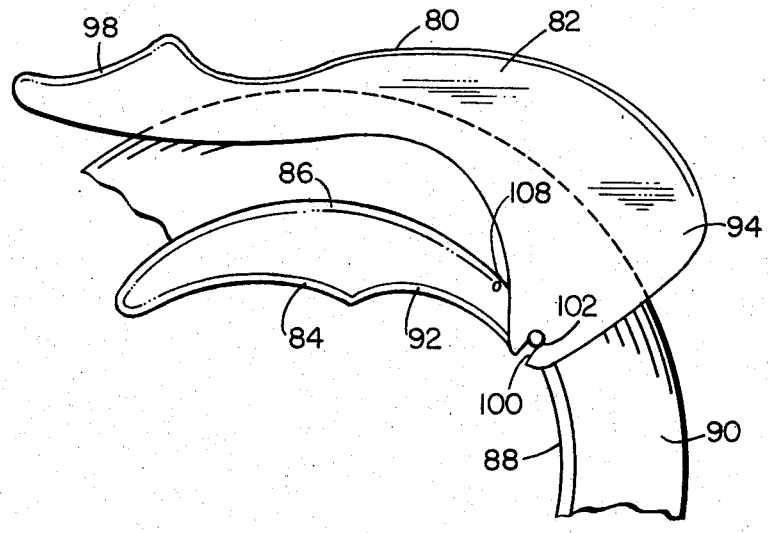
FIG. 11 is a side elevational view of a modified tape dispenser.

A further embodiment of the invention is disclosed in FIGS. 11, 12, 13, 14 and 15. Referring to FIG. 11, the tape dispenser 80 is again comprised of two separable parts, a cover piece 82 and a core or finger grip piece 84. The finger grip piece 84 is cresent-shaped having a partially circular peripheral section 86 contoured to fit snugly within an annular core 88 in a roll of tape 90, shown in phantom, and a finger rest section 92 contoured to provide a comfortable finger grip.

Figure 12:
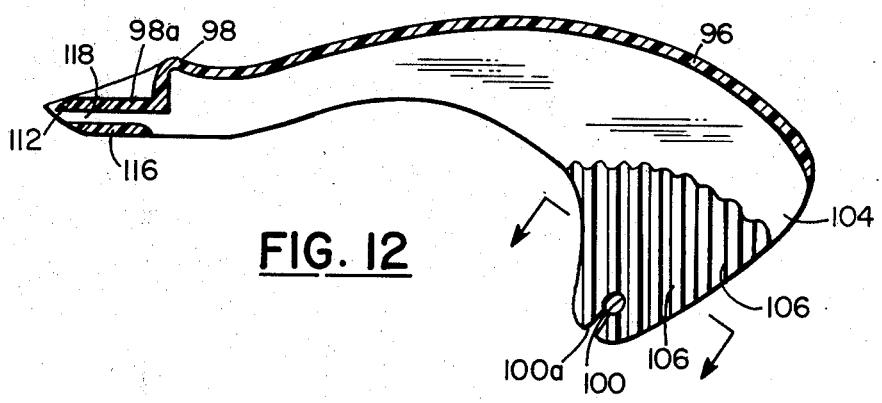
FIG. 12 is a cross-sectional view of the cover piece of the tape dispenser of FIG. 1.

The cover piece is contoured with two side sections 94 and a connecting back or top section 96 shown in FIG. 12. The side sections 94 and top section taper to an extension 98 from which tape is dispensed and severed. As in the primary embodiment the cover piece 82 and finger grip piece 84 are interconnected, by keyhole slots 100 on the cover piece and oppositely directed beveled studs 102 on one end of the finger grip piece. This manner of interconnection prevents disengagement of the two separable parts when oriented substantially in their operating position.

In order to retain the two separable parts in their operating position and to compensate for a depleting roll of tape, a modified retention arrangement has been devised which allows the cover piece to be fabricated in a single piece utilizing a simple die arrangement. Referring to the cross-sectional view showing the inside of the front cover piece 82, the inside surface 104 in the area of the keyhole slot 100 includes a parallel series of regular grooves 106. This arrangement facilitates extraction of a moulding die from the cover piece when it is withdrawn directionally along the line of the parallel grooves, as schematically illustrated by the directional arrow in FIG. 12.

The parallel grooves are engaged by one or both of two protruberances 108 and 110 on the finger grip piece 84 depending on the state of depletion of the tape roll. The protruberances are located on one side of the circular peripheral section 86 of the finger grip piece 84, proximate to one of the beveled studs 102, as shown in the cross-sectional view of FIG. 13. As the tape roll depletes, the innermost protuberance 110 successively engages the parallel grooves 106. The other protuberance similarly engages the parallel grooves at a greater radial distance from the point of pivot at the studs, to provide additional latching action. While one protuberance will adequately provide the desired result, the location must necessarily be close to the point of pivot to allow for continuous engagement of the elements. A second protuberance 110 is desired to provide the added leverage to maintain the relative position of the finger grip piece 84 and the cover piece 82. Even though the second protuberance 110 does not initally engage the grooves as shown in FIG. 1, it nevertheless engages the grooves during most of the life of the tape roll providing some relief to the first protuberance 108. This second protuberance 110 may be omitted without affecting the operation of the successive latching between the finger grip piece 84 and the cover piece 82.

Figure 13:
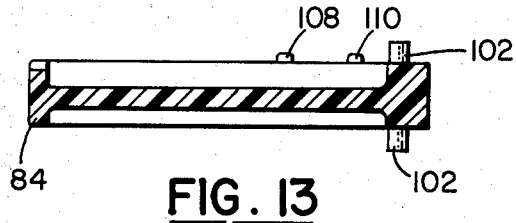
FIG. 13 is a cross-sectional view of the finger grip piece of the tape dispenser of FIG. 1.
Figure 14:
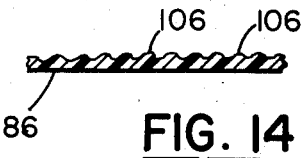
FIG. 14 is a cross-sectional view of a portion of the cover piece taken on the lines 14—14 in FIG. 12.
Figure 15:
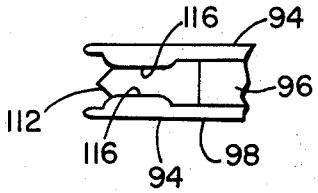
FIG. 15 is an enlarged bottom view of the extension portion of the cover piece of FIG. 1.

For smooth action between the protuberance and grooves, the end of the protuberance is rounded as shown in the cross-sectional view of the finger grip piece 84 in FIG. 13, and the grooves 106 are curved as shown in the cross sectional view of a portion of the cover piece 86 in FIG. 14. The curved configuration of the grooves 106 also reduces any possibility of fracturing or splitting the cover piece as would be more likely were the grooves V-shaped.

In the embodiment of the tape dispenser shown generally in FIG. 11, the cover piece 82 can be fabricated by a die molding process in one piece. As shown in the cross-sectional view of FIG. 12 a cutting edge 112 is integrally formed on the extension 98 of the top section 96. This cutting edge is V-shaped as illustrated in the partial underside view in FIG. 15 and is protected by the tapered points 114 of the side sections 94 at the end of the extension 98.

As in the other embodiments, the extension 98 includes a pair of protruding tape guides 116 which are oppositely mounted to the inside of the cover sections 94. These guides comprise a self loading feature to the tape dispenser. Essentially, tape extracted from the tape roll need not be threaded through a guide means. Rather, the tape is pulled tautly from the roll, utilizing the finger grip piece and cover as a brake to maintain the tautness of the extracted segment of tape, and the tape is simultaneously lifted up against the knife edge without severing the tape. The tape deforms in shape by bowing sufficiently to slip between the guides 116 and the edges of the tape become retained in the slot 118 formed between the guides 116 and the extension end 98*a* designated in FIG. 12. The tape is further extracted after severing by utilizing a finger pressed against the underside of the tape between the guides and sliding the tape beyond the knife edge 112 until the tape is grasped between the fingers. The tape extracted is severed by gripping the finger grip piece to brake the roll of tape between the grip piece and cover piece and lifting the extracted segment against the knife edge.

The general size of the tape dispenser is, of course, constructed to the size of the tape roll. For a wider tape roll than shown in the drawings, the cover piece and finger grip piece must, of coarse, necessarily be constructed with a conformingly wider width.

While in the foregoing specification an embodiment of the invention has been set forth in considerable detail for purposes of making a complete disclosure thereof, it will be apparent to those skilled in the art that numerous changes may be made in such details without departing from the spirit and principles of the invention.

What is claimed is:

1. A tape dispenser for dispensing tape from a conventional tape roll having an annular core, said tape dispenser comprising: a finger grip piece having a crescent configuration insertable within the core of the tape roll, said finger grip piece having a first peripheral portion conforming with a portion of the annular core, and a second peripheral portion adapted for finger contact; a cover piece having a top section with an underside contoured in part to the outer periphery of a tape roll and having opposite side sections covering in part the sides of a tape roll, said top section and side sections forming a tapered extension at one end of said cover piece wherein said underside of said top section in said extension projects a distance substantially tangential from the outer periphery of the tape roll and includes a guide surface for separating tape from the tape roll and a termination with a cutting means; means for hingedly connecting said finger grip piece at one end of said finger grip piece and said cover piece at said side sections; and tape guide means in said extension wherein said guide means comprises oppositely facing elongated protrusions on the side sections substantially parallel to and proximately spaced from the underside of the top section at the tapered extension, each of said protrusions forming a slot on each of the opposed side sections of the extension and cooperatively providing a channel through which tape is dispensed, said protrusions being spaced apart a distance relative to the width of a tape which causes the tape to deform by bowing which permits the opposite edges of a tape to pass by when the tape is pulled up flatly against the underside of the top section, said protrusions being adapted to engage a narrow portion of the opposite edges of a tape and retain the tape substantially against the underside of the top section at said extension.

2. The tape dispenser of claim 1 wherein said hinge means comprises oppositely arranged keyhole slots on said opposite side sections, said keyhole slots having a substantially straight segment running inward from the edge of said opposite side sections and a circular segment, and outwardly projecting beveled studs at one end of said finger grip piece wherein said beveled studs have at least one flat face, which when aligned with said straight segment allow sliding engagement of said studs in said straight segment to said circular segment, said sliding engagement being prevented when flat face is not aligned with said straight segment, wherein said studs and finger grip piece are rotatable with respect to said keyhole slots and cover piece when said studs are located in said circular segments.

3. The tape dispenser of claim 2 comprising further: adjustment means cooperating with said hinge means for adjusting the retentive position of said cover piece with respect to said finger grip piece as the tape roll is depleted, said adjustment means comprising a plurality of parallel grooves in the inside of at least one side section of the cover piece and at least one cooperating protrusion on the side of said finger grip piece wherein said protrusion is successively engageable in said parallel grooves as said tape roll is depleted and wherein said parallel grooves are proximate to said keyhole slot and are parallel to said straight segment of said keyhole slot.

4. The tape dispenser of claim 3 wherein said protrusion has a rounded end and said grooves are curved in cross-section.

5. The tape dispenser of claim 1, comprising further: adjustment means cooperating with said hinge means for adjusting the retentive position of said cover piece with respect to said finger grip piece as the tape roll is depleted, said adjustment means comprising a plurality of parallel grooves in the inside of at least one side section of the cover piece and at least one cooperating protrusion on the side of said finger grip piece wherein said protrusion is successively engageable in said parallel grooves as said tape roll is depleted and wherein said parallel grooves are proximate to said keyhole slot.

6. The tape dispenser of claim 1 comprising further a knife blade having at least one pointed, V-shaped, cutting edge and means in said extension for removably mounting said knife edge in said extension.

7. The tape dispenser of claim 1 having further adjustment means cooperating with said hinge means for adjusting the retentive position of said cover piece with respect to said finger grip piece as the tape roll is depleted.

8. The tape dispenser of claim 7 wherein said adjustment means comprises a lip on at least one of said side sections and a cooperating series of cooperating detents on at least one side of said finger grip piece.

9. The tape dispenser of claim 7 wherein said adjustment means comprises a ridge and groove facing radially projecting from said hinge means on said finger grip piece and a cooperating ridge and groove facing radially projecting from said hinge means on said cover piece.

10. A tape dispenser for dispensing tape from a conventional tape roll having an annular core, said tape dispenser comprising: a finger grip piece having a crescent configuration insertable within the core of the tape roll, said finger grip piece having a first peripheral portion conforming with a portion of the annular core, and a second peripheral portion adapted for finger contact; a cover piece having a top section with an underside contoured in part to the outer periphery of a tape roll and having opposite side sections covering in part the sides of a tape roll, said top section and side sections forming a tapered extension at one end of said cover piece; means for hingedly connecting said finger grip piece at one end of said finger grip piece and said cover piece at said side sections; tape guide means in said extension wherein said guide means comprises oppositely facing elongated protrusions on the said sections substantially parallel to and proximately spaced from the underside of the top section at the tapered extension to provide a channel through which tape is dispensed, said protrusions being spaced apart a distance relative to the width of a tape which permits the opposite edges of a tape to pass by when the tape is pulled up flatly against the underside of the top section, said protrusions being adapted to engage a narrow portion of the opposite edges of a tape and guide the tape substantially against the underside of the top section as said extension; and, a knife blade located at the end of said top section at said extension, said extension having means for removably mounting said knife blade, said knife blade having a first edge and a second edge, said blade being selectively mountable in said mounting means with a selected edge projecting for use.

11. The tape dispenser of claim 10 wherein said opposite side sections at said extension project at least to the projecting edge of the knife blade to protect a user from injury.

* * * * *